US005863694A

United States Patent [19]

Sano et al.

[11] Patent Number: 5,863,694

[45] Date of Patent: Jan. 26, 1999

[54] TONER FOR DEVELOPING ELECTROSTATIC LATENT IMAGE WITH SPECIFIC PARTICLE-SIZE DISTRIBUTION

[75] Inventors: Tetsuo Sano; Yoshitaka Sekiguchi, both of Amagasaki; Satoru Iwata, Toyokawa; Hiroyuki Fukuda, Kobe, all of Japan

[73] Assignee: Minolta Co., Ltd., Osaka, Japan

[21] Appl. No.: 796,858

[22] Filed: Feb. 5, 1997

Related U.S. Application Data

[63] Continuation of Ser. No. 398,448, Mar. 3, 1995, abandoned.

[30] Foreign Application Priority Data

Mar. 4, 1994 [JP] Japan ..... 6-034666

[51] Int. Cl.[6] ..... G03G 9/087

[52] U.S. Cl. ..... 430/111; 430/109; 430/110; 430/137

[58] Field of Search ..... 430/111, 106.6, 430/109, 110, 137

[56] References Cited

U.S. PATENT DOCUMENTS

| | | | |
|---|---|---|---|
| 3,674,736 | 7/1972 | Lerman et al. | 430/137 |
| 4,284,701 | 8/1981 | Abbott et al. | 430/111 |
| 4,363,861 | 12/1982 | Nakamura et al. | 430/97 |
| 4,626,487 | 12/1986 | Mitsuhashi et al. | 430/109 |
| 4,782,001 | 11/1988 | Kanda et al. | 430/137 |
| 4,833,057 | 5/1989 | Misawa et al. | 430/109 |
| 4,863,824 | 9/1989 | Uchida et al. | 430/109 |
| 4,917,982 | 4/1990 | Tomono et al. | 430/99 |
| 4,933,251 | 6/1990 | Ichimura et al. | 430/109 |
| 4,985,327 | 1/1991 | Sakashita et al. | 430/106.6 |
| 5,009,973 | 4/1991 | Yoshida et al. | 430/45 |
| 5,120,631 | 6/1992 | Kanbayashi et al. | 430/111 |
| 5,137,796 | 8/1992 | Takiguchi et al. | 430/111 |
| 5,223,365 | 6/1993 | Yamamoto et al. | 430/137 |
| 5,234,788 | 8/1993 | Morimoto et al. | 430/106.6 |
| 5,438,395 | 8/1995 | Koga et al. | 430/106.6 |
| 5,576,393 | 11/1996 | Yamashita et al. | 430/111 |

FOREIGN PATENT DOCUMENTS

| | | | |
|---|---|---|---|
| 55-088074 | 7/1980 | Japan | 430/111 |
| 4-199155 | 7/1992 | Japan | 430/111 |

OTHER PUBLICATIONS

Webster's II New Riverside University Dictionary, p. 621, 1984.

*Primary Examiner*—Christopher D. Rodee
*Attorney, Agent, or Firm*—Burns, Doane, Swecker & Mathis, LLP

[57] ABSTRACT

The present invention relates to a toner for developing a digital-image, comprising particles having rounded surfaces and having the following size distribution:

$$\log [Y] = -0.16\,X + k \quad (2.4 \leq k \leq 2.7)$$

$$5.0 \leq X \leq 11.7\ [\mu m]$$

wherein [X] represents an average particle size by volume size and [Y] represents % by number of particles of not more than 5 $\mu$m.

26 Claims, 2 Drawing Sheets

TONER FOR DEVELOPING ELECTROSTATIC LATENT IMAGE WITH SPECIFIC PARTICLE-SIZE DISTRIBUTION

This application is a continuation of application Ser. No. 08/398,448, filed Mar. 3, 1995 abandoned.

BACKGROUND OF THE INVENTION

1. Field of the Invention

The present invention relates to a toner for developing electrostatic latent image and, more particularly, to an electrostatic latent-image developing toner for use with a digital-system electrophotographic apparatus.

2. Description of the Prior Art

Analog-system electrophotographic apparatuses, including copying machines, have been in general use such that light from the light source is illuminated onto an original so that the light reflected from the original is directed to the photoconductor to form an electrostatic latent image on the photoconductor. Also, an image-forming apparatus of digital-system in which a toner-containing developer is supplied to an electrostatic latent image produced in dot unit (digital writing) has been in practical use, including digital copying machines and electrophotographic facsimile units in which image formation is made on the basis of image information read by a printer or image reader as used as an output at a computer terminal.

In the image-forming apparatus of digital-system, an electrostatic latent image is formed on the photoconductor in a unit of dot by digital writing by irradiation of light-beam or light-shutter array, and the latent image is subjected to normal or reversal development; then the resulting toner image is transferred onto a recording medium, such as recording paper, then fixed, whereby a recorded image is produced. Therefore, the toner used in such digital system is required to have good dot-reproducibility. In order to meet such requirement, the toner must have good charging stability. That is, it is necessary that the toner should have stable charging properties such that it is not liable to any substantial variation in the quantity of applied charge due to environmental factors, such as changes in humidity and temperature.

Toner, as in a two-component developing system for example, is triboelectrified by contact with a carrier; and in a single-component developing system, toner is triboelectrified by contact with charge giving members, such as blade and sleeve. However, when any toner component deposits on carrier or charge giving members in the course of repetitive development, the triboelectric function of the carrier or charge giving members in relation to the toner will be lowered and, as a result, the amount of charge applied to the toner will be diminished. In order to enhance the charging stability of the toner, therefore, it is necessary that the toner should have good spent resistance in relation to the carrier and charge giving members.

SUMMARY OF THE INVENTION

It is an object of the present invention to provide a toner for developing an electrostatic latent image which has good charging stability.

It is another object of the invention to provide a toner for developing an electrostatic latent image which is less spent on carrier and/or charge giving members.

It is another object of the invention to provide a toner suitable for an image-forming apparatus of digital system.

The present invention relates to a toner for developing a digital-image, comprising particles having rounded surfaces and having the following size distribution:

$$\log [Y] = -0.16\,X + k \quad (2.4 \leqq k \leqq 2.7)$$

$$5.0 \leqq X \leqq 11.7\ [\mu m]$$

wherein [X] represents an average particle size by volume size and [Y] represents % by number of particles of not more than 5 $\mu$m.

DETAILED DESCRIPTION OF THE INVENTION

Figure 1:
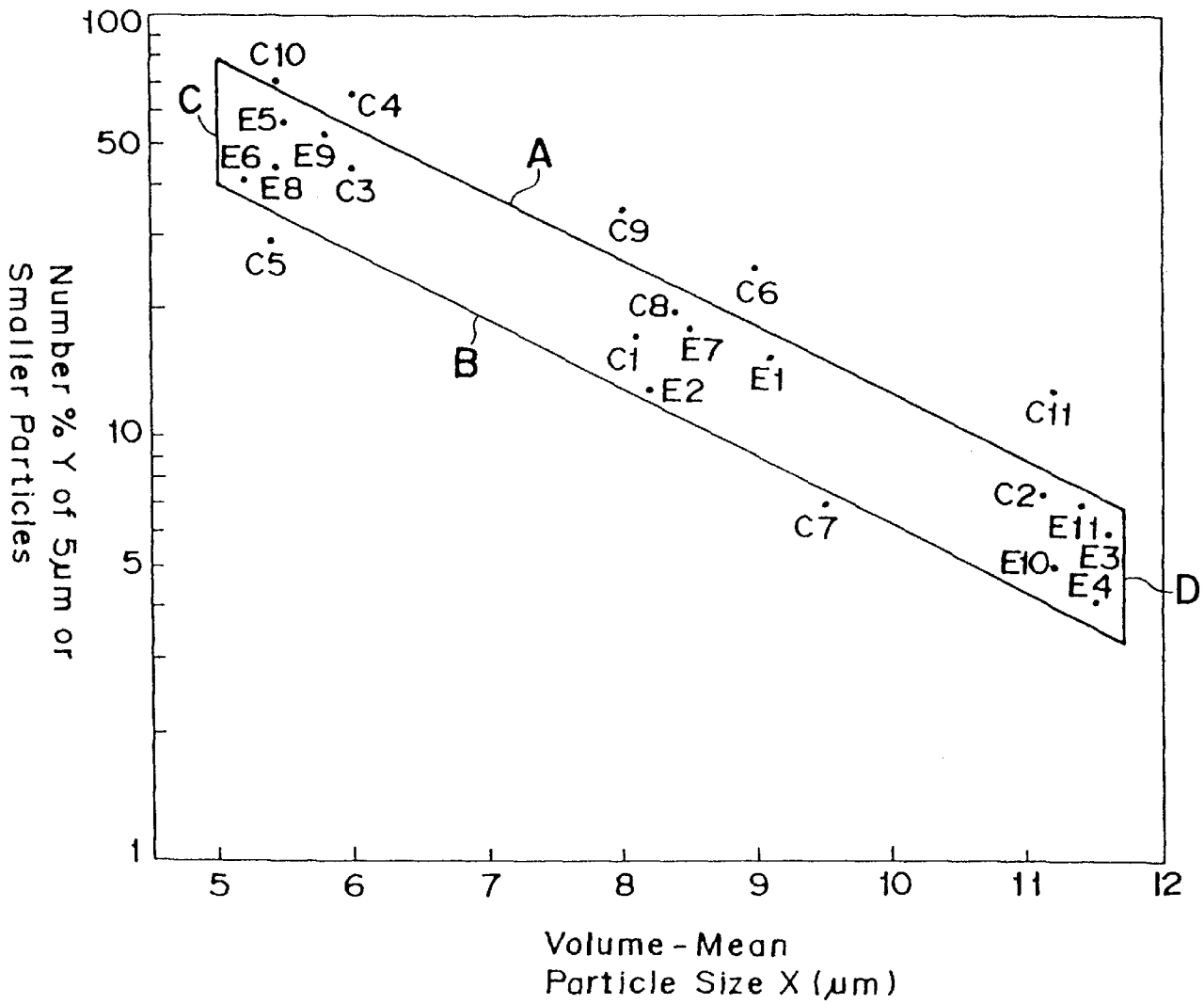
FIG. 1 is a graph in which number % Y of toner particles of not more than 5 $\mu$m in particle size vs. volume-average particle size X of toner is plotted.

The present inventors made extensive research on toners for use with an image-forming apparatus of digital-system and, as a result, it has been found that the charging stability of the toner is influenced by the particle size distribution of the toner as well as by the particle shape of the toner. Specifically, it has been found that good charging stability can be insured by using a toner such that a certain relationship is satisfied between the fine particle content of the toner with a particle size of not more than 5 $\mu$m and the mean particle size of the toner, and such that individual toner particles are subjected to a smoothing process to have a corner-free and rounded configuration despite the fact that the toner has been produced by pulverization. It has thus been found possible to provide a toner having good dot reproducibility. In the present invention, a digital system means a system to form electrostastic latent images in dot unit on a photoconductor.

The present invention provides a toner for developing a digital-image, comprising particles having rounded surfaces and having the following size distribution:

$$\log [Y] = -0.16\,X + k \quad (2.4 \leqq k \leqq 2.7)$$

$$5.0 \leqq X \leqq 11.7\ [\mu m]$$

wherein [X] represents an average particle size by volume size and [Y] represents % by number of particles of not more than 5 $\mu$m.

In the present invention, a toner is used wherein the toner has a volume-average particle size of 5.0–11.7 $\mu$m, and wherein the relation between the volume-average particle size (X) and the number % (Y) of toner particles of not more than 5 $\mu$m satisfies the relation:

$$\log Y = -0.16X + k \quad (2.4 \leqq k \leqq 2.7).$$

In this way, the toner contains a specified quantity of toner particles of not more than 5 $\mu$m in corresponding relation to the average particle size of the toner, whereby the toner can exhibit improved charging stability. This makes it possible to achieve good dot reproducibility, and clear and fog-free image reproduction. An average particle size larger than 11.7

μm is disadvantageous from the view point of high-precision image reproduction. Preferable particle size is 9 μm or less in average particle size. An average particle size smaller than 5 μm involves considerable limitations in production aspects (such as costs). It is noted that the foregoing equation has been drawn from the graph shown in FIG. 1 as obtained on the basis of experimental data of those examples and comparative examples which will be explained hereinafter. In the graph, E1–E11 denote Examples 1 to 11, and C1–C11 denote Comparative Examples 1 to 11.

Further, in the present invention, a toner is used which has a surface shape of a corner-free and rounded configuration despite the fact that the toner is prepared by milling. The use of a toner having such configuration can enhance toner fluidity although a smaller particle-size toner tends to decrease in fluidity. The fact that particles of the toner are corner-free can enhance the uniformity of charge distribution with respect to each toner particle (i.e., charge concentration on a corner portion of the particle is eliminated). The uniformity of toner surface shape effects to improve the charging stability of the toner, resulting stabilization of charge holding rate and image density, and formation of good images without fogs.

Conventionally, in the pulverization process, colorant, binder resin, and other desired additives are mixed, then kneaded, and the resulting mixture is roughly ground and then pulverized to a desired particle size. Subsequently, the obtained particles are classified. Toner particles thus produced have a ruptured surface and are indefinitely configured with some angular irregularity. Therefore, individual toner particles are differently shaped, and this unfavorably affects the fluidity and charging stability of the toner.

The toner particles having corner-free shape can be obtained by, for example, classifying (separating fine particles) toners which have been prepared by pulverization to a desired particle size, by using a classification-rotor type classifier, or mixing such toners by means of a pulverizer utilizing mechanical impact force. From the standpoint of cost economy or the like, it is preferable to carry out such operation using a classification-rotor type classifier which can simultaneously perform both classifying and rounding operations. Through such processing it is possible to obtain a toner which is characteristically improved in chargeability, durability with respect to copy, heat resistance, fluidity, and environmental stability. Reasons for this are: that the use of such a classifier results in the surface of toner particle being rounded by impact force applied by the classification rotor; that by the action of impact force due to the classification rotor fine particles of not more than ⅓ or not more than ¼ of the mean toner particle size, which would be a cause of fogging or the like, are caused to adhere to and become buried in the surfaces of individual toner particles thereby to reduce free fine particles; and that the impact force of the rotor provides a dispersion effect to enhance the classification efficiency thereby to prevent inclusion of fine particles into final toner and likewise prevent generation of free charge control agent. Such effects cannot be provided by any conventional air classifier which operates to classify particles according to particle weight because it has not classification rotors. As the degree of such processing is increased, toner particles will become spherical. If the toner particles are rendered completely spherical in shape, there will occur toner passing-through in case of blade cleaning, which may result in some defective cleaning. From the standpoint of blade cleaning, therefore, it is preferable that toner particles have a corner-free configuration with some indefinite shape.

Figure 2:
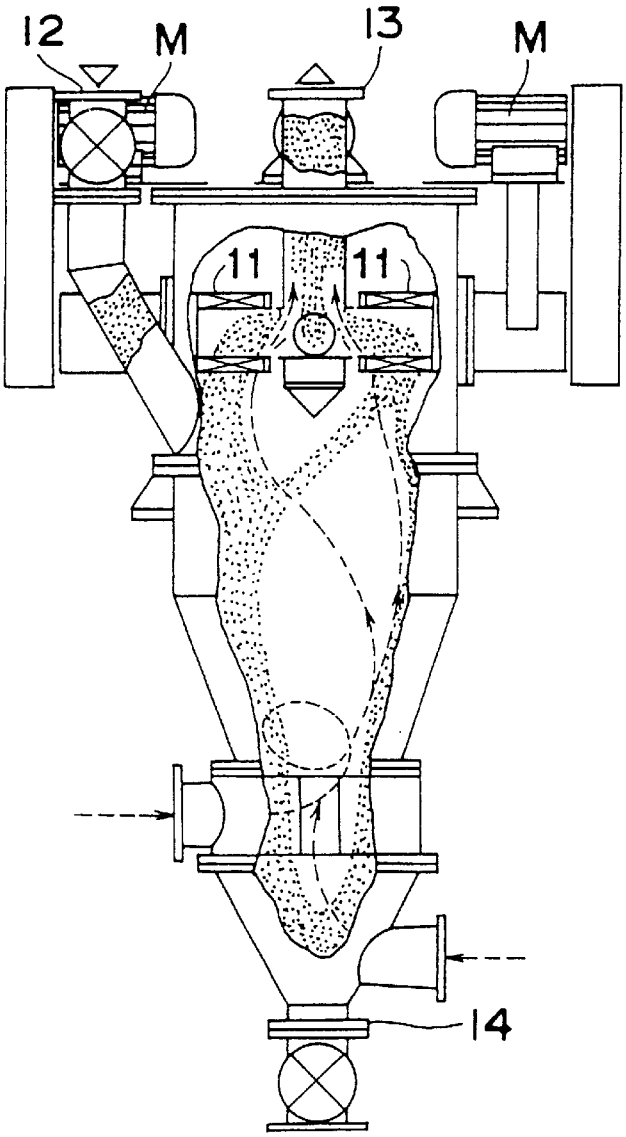
FIG. 2 illustrates a center-perpendicular sectional view of one example of classification rotor-type classifier.
Figure 3:
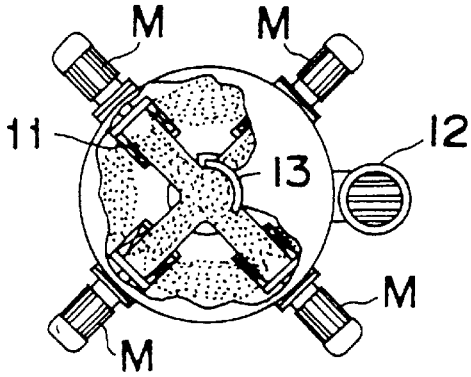
FIG. 3 shows a horizontal sectional view of a classifying portion of FIG. 2 classification rotor-type classifier.

The are known various classifiers of the above described classification-rotor type, including "Turbo classifier" (made by Nisshin Engineering K.K.) and "DONASELEC" (made by Japan Donaldson K.K.). Particularly preferred of those known classifiers are "TURBOPLEX ULTRAFIN Powder Classifier 50-1000 ATP Series" classifiers (made by Hosokawamicron K.K.). A TURBOPLEX multiwheel type classifier is schematically shown in FIGS. 2 and 3. FIG. 2 is a perpendicular sectional view of a central portion of the classifier, and FIG. 3 is a horizontal sectional view of a classifying portion.

Raw material (toner particles prepared to a predetermined particle size by pulverization) is introduced through a material input port (12) and carried into a classification chamber via a rotary valve as shown in FIG. 2 or together with inflow air. Inflow air flows upward within the classification chamber from a bottom portion as shown by arrow. The material travels upward according to the flow of air to enter the classifying portion (11) for being classified therein. Fine particles are removed from a common fine particle discharge port (13). The classifying portion has a plurality of separately driven classifying rotors (11) horizontally mounted therein. The rotors are driven by a motor. Common speed control is effected through one frequency converter. Toner particles used as raw material may be those which have been classified by air before they are fed to the classification-rotor type classifier. The classified materials (toner particles) with fine particles removed are taken out from a discharge portion (14). The classified materials are given physical impacts generated by rotation of the rotor (11), so that surface corners are removed to be rounded.

Resins useful as a binder for the toner of the invention may be any such resin as is conventionally used as a toner binder. Examples of such resins include thermoplastic resins, such as polystyrene resins, poly(meth)acrylic resins, polyolefin resins, polyamide resins, polycarbonate resins, polyether resins, polysulfone resins, polyester resins, epoxy resins, and butadiene resins; thermosetting resins, such as urea resins, urethane resins, and epoxy resins; and their copolymers, block polymers, graft polymers, and polymer blends. The foregoing resins are not particularly limited to those which are in complete polymer state as, for example, in the case of thermoplastic resins, but those containing an oligomer or a prepolymer, a crosslinking agent or the like as in thermosetting resins may be used as well.

The toner of the present invention may be added with a charge control agent, an off-set preventive agent, or the like, in addition to colorant and binder resin.

Useful positive charge control agents include, for example, azine compound Nigrosine base EX, Bontron N-01, 02, 04, 05, 07, 09, 10, 13 (made by Orient Kagaku Kogyo K.K.), Oil Black (made by Chuo Gosei Kagaku K.K.), quaternary ammonium salt P-51, polyamine compound P-52, Sudan Chief Schwaltz BB (solvent black 3: C. I. No. 26150), Fett Schwaltz HBN (C. I. No. 26150), Brilliant Spirit Schwartz TN (made by Farbenfabriken Bayer K.K.), alkoxylated amine, alkylamide, chelate molybdate pigment, and imidazole compounds.

Useful negative charge control agents include, for example, chromium complex salt type azo dyes S-32, 33, 34, 35, 37, 38, and 40 (made by Orient Kagaku Kogyo K.K.), Aizen Spilon Black TRH, BHH (made by Hodogaya Kagaku K.K.), Kayaset Black T-22,004 (made by Nippon Kayaku K.K.), copper phthalocyanine dye S-39 (made by Orient Kagaku Kogyo K.K.), chromium complex salt E-81, 82 (made by Orient Kagaku Kogyo K.K.), zinc complex salt E-84 (made by Orient Kagaku Kogyo K.K.), aluminum complex salt E-86 (made by Orient Kagaku Kogyo K.K.), Carix allene compound E89 (made by Orient Kagaku Kogyo K.K.) and iron complex salts T-77 (made by Hododani Kagaku K.K.).

The above enumerated charge control agents which is relatively large in particle size are to be used, it is preferable that the agent be processed, for example, pulverized, to a desired particle size before the agent is used.

In case that a charge control agent is to be internally dispersed in the toner, it is desirable that 0.1 to 20 parts by weight, preferably 0.1 to 10 parts by weight, of the charge control agent are added relative to 100 parts by weight of the binder resin for the toner. Where the charge control agent is to be adhered and fixed to toner particle surface, it is desirable that 0.001 to 10 parts by weight, preferably 0.05 to 2 parts by weight, are added relative to 100 parts by weight of the binder resin for the toner.

The toner in accordance with the invention may be added with an off-set preventive agent if required. Useful off-set preventive agents include, for example, polyolefin waxes, such as low molecular weight polyethylene wax, low molecular weight oxidation-type polyethylene wax, low molecular weight polypropylene wax, and low molecular weight oxidation-type polypropylene wax, higher fatty acid wax, higher fatty ester wax, sazol wax, candelilla wax, and carnauba wax. These agents may be used alone or in combination of two or more kinds. An off-set preventive agent may be added in an amount of 1 to 15 parts by weight, preferably 2 to 15 parts by weight, relative to 100 parts by weight of the binder resin for the toner. In case that a resin having a polar group as in a polyester resin is used as a binder resin, it is desirable that an oxidation type olefin wax is used as an off-set preventive resin. Compatibility can be enhanced.

It is desirable that the toner of the invention has its surface added with a fluidizing agent, and such addition treatment is preferably carried out by mechanically mixing toner and fluidizing agent together. Useful fluidizing agents include, for example, silica fine particles, titanium dioxide fine particles, alumina fine particles, magnesium fluoride fine particles, silicon carbide fine particles, boron carbide fine particles, titanium carbide fine particles, zirconium carbide fine particles, zirconium nitride fine particles, titanium nitride fine particles, magnetite fine particles, molybdenum disulfide fine particles, aluminum stearate fine particles, magnesium stearate fine particles, and zinc stearate fine particles, which may be used alone or in combination of two or more kinds. The addition amount of fluidizing agent may be 0.05 to 2 wt %, preferably 0.1 to 1 wt %, relative to the toner. If the addition amount is less than 0.05 wt %, the toner fluidity is insufficient. If the addition amount is more than 2 wt %, the environmental stability of the toner will be impaired; and especially when the toner is used in a high temperature/high humidity environment, there will arise a lowering problem of toner-charging. Fluidizing agents are preferably used which have been hydrophobically treated, and for hydrophobic treatment, silane coupling agent, titanium coupling agent, higher fatty acid, silicone oil, etc. may be used.

Further, in the present invention, it is desirable that electroconductive fine particles are added in combination with the fluidizing agent. For use as such conductive fine particles, titanium dioxide treated with tin oxide for conductivity, or titanium dioxide treated with tin oxide-antimony oxide for conductivity are preferred.

The toner of the present invention may be used as a magnetic toner. For this purpose, known magnetic particles may be dispersed in the binder resin. Known magnetic materials which may be used for the purpose include, for example, ferromagnetic metals, such as cobalt, iron and nickel, alloys of such metals as cobalt, iron, nickel, aluminum, lead, magnesium, zinc, antimony, beryllium, bismuth, cadmium, calcium, manganese, selenium, titanium, tungsten, and vanadium, and mixtures, oxides, and calcined substances (ferrites) of these metals.

The toner of the invention can be used with two-component developer which is used together with a carrier, and also used as a single component developer with which no carrier is used. For use with the toner of the invention, carriers which have been known in the art of electrophotographic developer may be used. Preferred carrier is a binder-type carrier with magnetic fine particles dispersed in a binder resin or a coat-type carrier with surface of core particle coated with resin.

Embodiments of the present invention will now be described, but it is to be understood that the invention is in no way limited by the embodiments.

(Preparation of Polyester Resin A)

A 2-liter four-necked mouthed flask, fitted with a reflux condenser, a water separator, a nitrogen gas introduction pipe, a thermometer, and an agitator device, was set in a mantle heater. Into the flask were charged 735 g of polyoxypropylene (2, 2) -2, 2-bis (4-hydroxy-phenyl) propane, 292.5 g of polyoxyethylene (2, 0) -2, 2 -bis (4-hydroxyphenyl) propane, 448.2 g of terephthalic acid, and 22 g of trimellitic acid, which were caused to react with stirring at 220° C. while nitrogen was introduced into the flask. The progress of reaction was followed while acid value measurement is made. Reaction ended when the predetermined acid value was reached. Thus, a polyester resin A having softening point of 18.3° C. was obtained. The softening point was determined by using a downward movement type flow tester (CFT-500: made by Shimazu Seisakusho K.K.) under the conditions of: fine hole diameter of dice of 1 mm, applied pressure of 20 kg/cm$^2$, and heating rate of 6° C./min, a 1 cm$^3$ in such a way that sample was melted and caused to flow out, in which case a temperature corresponding to one half of the height from the starting point of flow and up to the ending point of flow was taken as the softening point.

(Preparation of Polyester Resin B)

A polyester resin B having a softening point of 152.5° C. was obtained in the same way as in the preparation of resin A, except that 35 g of polyoxypropylene (2, 2) -2, 2 -bis (4-hydroxyphenyl) propane, 292.5 g of polyoxyethylene (2, 0) -2, 2 -bis (4-hydroxyphenyl) propane, 249 g of terephthalic acid, 177 g of succinic acid, and 22 g of trimellitic acid were used.

(Preparation of Polyester Resin C)

A polyester resin C1 having a softening point of 111° C. was obtained in the same way as in the preparation of resin A, except that a 51 four-necked flask, fitted with a reflux condenser, a water separator, a nitrogen gas introduction pipe, a thermometer, and an agitator device, was set in a mantle heater, and that 1376 g of polyoxypropylene (2, 2) -2, 2 -bis (4-hydroxyphenyl) propane, and 472 g of isophthalic acid were used, and caused to react at 240° C. with stirring.

Similarly, a polyester resin C2 having a softening point of 62° C. was obtained in the same way, except that 1720 g of polyoxypropylene (2, 2) -2, 2 -bis (4-hydroxyphenyl) propane, 860 g of isophthalic acid, 119 g of succinic acid, 129 g of diethylene glycol, and 74.6 g of glycerin were used, and caused to react at 240° C. with stirring.

Introduced into a Henschel mixer were 420 parts by weight of polyester resin C1 and 280 parts by weight of polyester resin C2, which were mixed together until a sufficiently uniform mixture was obtained. Subsequently, the mixture was put into a heating kneader and 100 parts by weight of diphenylmethane—4, 4 -diisocyanate were charged thereinto. All the contents were caused to react for one hour, then cooled. Thus, a polyester resin C having a urethane bond, with a softening point of 140° C., was obtained.

EXAMPLE 1

| | |
|---|---|
| Polyester resin A | 65 wt parts |
| Polyester resin B | 35 wt parts |
| Oxidation-type polypropylene (Viscol TS-200: made by Sanyo Kasei Kogyo K.K.) | 3 wt parts |
| Negative charge control agent (Bontron s-34: made by Orient Kagaku Kogyo K.K.) | 5 wt parts |
| Carbon black (Morgul L: made by Cabot K.K.) | 8 wt parts |

The above materials were well mixed in Henschel mixer, and the mixture was melt and kneaded in a twin screw excluder kneader, then cooled. Subsequently, the cooled mixture was roughly pulverized in a hammer mill. The resultant mixture was then pulverized finely in a jet pulverizer. As a result, pulverized toner particles having a volume-mean particle size of 8.6 $\mu$m were obtained. Thereafter, the particles were classified by means of a classification rotor-type classifier (100/4 ATP: made by Hosokawa Micron K.K.) under the conditions of: rotor speed of 9,300 rpm, secondary air flow of 7.5 $Nm^3$/min, total air flow of 14.5 $Nm^3$/min, and lover angle scale of 8. Thus, toner particles having a particle size distribution shown in Table 1 were obtained. Protrusions on the surface of toner particles had not edges.

The toner particles were admixed with 0.4 wt % of hydrophobic silica fine particles (H2,000: made by Nippon Aerosil K.K.) and 0.2 wt % of electroconductive titanium oxide (EC300: made by Chitan Kogyo K.K.)(treated with tin oxide and antimony oxide to have electroconductivity). A toner was thus obtained.

EXAMPLES 2 TO 6

Toner particles prepared by pulverization and having a volume-mean particle size shown in Table 1 were used and classification conditions were controlled in a manner similar to Example 1 to give a toner having a particle size distribution shown in Table 1. The fine particle content of the toner can be adjusted. The content decreases by decreasing the rotor speed, increasing the secondary air flow or total air flow, and/or narrowing the lover angle scale. The content increases by reversing the above conditions. Each of toners had not edges on the surface thereof.

(Comparative Examples 1 to 3)

Toner particles prepared by pulverization and having a volume-mean particle size shown in Table 1 were used to produce a toner in a manner similar to Example 1, except that an air classifier (DS-2; made by NPK K.K.) was employed in place of the classification rotor-type classifier. The particle size distribution of the toner obtained is shown in Table 1. The surface of toner was not rounded because the air classifier (DS-2) had not classification rotors.

(Comparative Examples 4 to 7)

In a manner similar to Example 1, toner particles prepared by pulverization and having a volume-mean particle size shown in Table 1 were used and classification conditions were controlled to give a toner having a particle size distribution shown in Table 1.

EXAMPLE 7

| | |
|---|---|
| Polyester resin C | 100 wt parts |
| Oxidation-type low-molecular weight polypropylene (Viscol TS-200: made by Sanyo Kasei Kogyo) | 2.5 wt parts |
| Negative charge control agent (Bontron S-34: made by Orient Kagaku Kogyo K.K.) | 3 wt parts |
| Carbon black (Morgul L: made by Cabot K.K.) | 8 wt parts |

The above materials were well mixed in Henschel mixer. The mixture was melt and kneaded in a twin screw excluder kneader, and then cooled. Subsequently, the cooled mixture was roughly pulverized in a hammer mill and then finely pulverized in a jet pulverizer. As a result, pulverized toner particles having a mean particle size of 8.1 $\mu$m were obtained. Thereafter, fine particle classification was carried out by means of a classification rotor-type classifier (100/4 ATP: made by Hosokawa Micron K.K.) under the conditions of: rotor speed of 9,500 rpm, secondary air flow of 7.5 $Nm^3$/min, total air flow of 14.5 $Nm^3$/min, and lover angle scale of 8. Thus, toner particles having a particle size distribution shown in Table 1 were obtained.

The obtained toner had not edges on the surface thereof.

The toner particles were admixed with 0.5 wt % of hydrophobic silica fine particles (Cabosil TS500: made by Cabot K.K.). Thus a toner was obtained.

EXAMPLES 8 TO 11

As in Example 7, toner particles prepared by pulverization and having a volume-mean particle size shown in Table 1 were used and classification conditions were controlled, Thus a toner having a particle size distribution shown in Table 1 was obtained.

Each toner had shape without edges on the surface thereof.

(Comparative Example 8)

In the same way as in Example 7, toner prepared by pulverization and having a volume-mean particle size shown in Table 1 were used to produce a toner, except that an air classifier (DS-2; made by NPK K.K.) was employed in place of the classification rotor-type classifier. The toner had a particle size distribution shown in Table 1.

EXAMPLES 9 TO 11

As in Example 7, toner particles prepared by pulverization and having a volume-mean particle size shown in Table 1 were used and classification conditions were controlled. Thus a toner having a particle size distribution shown in Table 1 was obtained.

TABLE 1

| | Volume mean particle size of powdered toner before classification (μm) | Particle size distribution of toner | | | | |
|---|---|---|---|---|---|---|
| | | Classifier | Volume mean particle size (μm) | Vol. % of 5μ or smaller particles | Vol. % of 12.7μ or larger particles | Number % of 5μ or smaller particles |
| Ex. 1 | 8.6 | ATP | 9.1 | 2.0 | 10.0 | 15.5 |
| Ex. 2 | 7.4 | ATP | 8.2 | 2.3 | 3.2 | 13.0 |
| Ex. 3 | 11.2 | ATP | 11.6 | 0 | 33.4 | 6.0 |
| Ex. 4 | 11.0 | ATP | 11.5 | 0 | 31.6 | 4.1 |
| Ex. 5 | 4.7 | ATP | 5.5 | 40.2 | 0 | 56.2 |
| Ex. 6 | 4.3 | ATP | 5.2 | 23.8 | 0 | 41.8 |
| Comp. Ex. 1 | 7.4 | DS | 8.1 | 3.2 | 3.0 | 17.3 |
| Comp. Ex. 2 | 10.7 | DS | 11.1 | 0.2 | 27.3 | 7.4 |
| Comp. Ex. 3 | 5.4 | DS | 6.0 | 25.1 | 0 | 44.0 |
| Comp. Ex. 4 | 5.6 | ATP | 6.0 | 28.7 | 0 | 65.9 |
| Comp. Ex. 5 | 4.3 | ATP | 5.4 | 17.2 | 0 | 29.1 |
| Comp. Ex. 6 | 8.6 | ATP | 9.0 | 5.1 | 10.4 | 25.2 |
| Comp. Ex. 7 | 8.8 | ATP | 9.5 | 0 | 0.2 | 7.0 |
| Ex. 7 | 8.1 | ATP | 8.5 | 2.7 | 5.4 | 18.0 |
| Ex. 8 | 4.5 | ATP | 5.4 | 20.2 | 0 | 42.0 |
| Ex. 9 | 5.0 | ATP | 5.8 | 24.4 | 0 | 53.2 |
| Ex. 10 | 10.7 | ATP | 11.2 | 0 | 27.9 | 5.0 |
| Ex. 11 | 10.9 | ATP | 11.4 | 0 | 34.7 | 7.0 |
| Comp. Ex. 8 | 8.1 | DS | 8.4 | 4.0 | 4.6 | 19.8 |
| Comp. Ex. 9 | 7.5 | ATP | 8.0 | 6.2 | 3.2 | 35.0 |
| Comp. Ex. 10 | 4.9 | ATP | 5.4 | 39.5 | 0 | 70.4 |
| Comp. Ex. 11 | 10.9 | ATP | 11.2 | 0.3 | 26.3 | 13.0 |

(Example of Carrier Preparation)

| | |
|---|---|
| Polyester resin<br>(Mn: 5,000, MW: 115000, Tg: 67° C., Tm: 123° C.) | 100 wt parts |
| Ferrite fine particles<br>(MFP-2, made by TDK KK.) | 500 wt parts |
| Colloidal silica dispersant<br>(Aerosil #200; made by Japan Aerosil K.K.) | 3 wt parts |

The above materials were well mixed in Henschel mixer. The mixture was melt and kneaded in a twin screw excluder kneader, and then cooled. After roughly pulverized, the mixture was finely pulverized in a jet mill. Further, classification was carried out using an air classifier to give a carrier having a mean particle size of 60 μm.

With respect to Examples 1–11 and Comparative Examples 1–11, logarithm of number % Y of toner particles of not more than 5 μm in particle size vs. volume-average particle size X (am) of toner is plotted in FIG. 1. In the FIG. 1, E1–E11 denote Examples 1–11 respectively. C1–C11 denote Comparative Examples 1–11 respectively.

(Evaluation)

(Experiment 1)

Toners of Examples 1 to 6 and Comparative Examples 1 to 7 were each mixed with the carrier obtained in the foregoing example of carrier preparation so that the proportion of the toner would be 5 wt %. Thus, two-component developers were prepared.

The developers were evaluated with respect to the following items.

(Evaluation of Environmental Variation Range)

First, under N/N environment (10° C., 38%), each of the developers was stirred in a roll mill for 10 minutes. The developer was allowed to stand for more than 2 hours under L/L environment (10° C., 15%) and under H/H environment (30° C., 85%) respectively, and measurement was then made of electrical charge quantity under each environment. If the difference between the electrical charge quantity of each developer as allowed to stand under L/L environment and that of the developer as allowed to stand under H/H environment is 12 μC/g or less, the developer can provide a stable picture even under variable environment. A difference greater than 12 μC/g is undesirable because such a difference makes it difficult to control, for example, stabilization of image quality by means of apparatus mechanism. The results are shown in Table 2.

(Charge Holding Rate after 10,000 (10K) times of copy)

Each developer obtained above was put in an electrophotographic printer (SP-500: made by Minolta Camera K.K.) to carry out a 10K times of copy. After the 10K times of copy, the developer was taken out, with only the carrier separated therefrom. The separated carrier and a toner were mixed again, and the quantity of electrical charge quantity Q' was measured to determine a rate of charge holding rate [(Q'/Q)×100; Q represents initial electrical charge]. The results are shown in Table 2.

(Fog Evaluation)

Initial copy images and post-10K copy images were visually observed to be ranked.

5: a copy images were fog-free and excellent,

4: an image involving little or almost no fog,

3: some fogs were observed without practical problem,

2: many fogs were observed with problem for practical use.

The results are shown in Table 2.

(Evaluation of Cleaning properties)

After 10K times of copy, the surface of the photoconductor was visually observed after passing through the cleaning blade. Evaluation was made to be ranked as follows:

o: No passing-through of toner particle.

x: cleaning failure due to passing-through of toner particle.

The results are shown in Table 2.

TABLE 2

| | Enviromental variation range (μC/g) | Charge holding rate (%) | Initial fogging | After-10K fogging | Cleanability |
|---|---|---|---|---|---|
| Ex. 1 | 7.2 | 85 | 5 | 5 | ○ |
| Ex. 2 | 7.9 | 80 | 5 | 5 | ○ |
| Ex. 3 | 4.9 | 92 | 5 | 5 | ○ |
| Ex. 4 | 5.2 | 90 | 5 | 5 | ○ |
| Ex. 5 | 11.1 | 75 | 5 | 4 | ○ |
| Ex. 6 | 10.0 | 82 | 5 | 4 | ○ |
| Comp. Ex. 1. | 9.8 | 60 | 4 | 3 | ○ |
| Comp. Ex. 2 | 8.1 | 72 | 5 | 3 | ○ |
| Comp. Ex. 3 | 15.5 | 45 | 3 | 1 | ○ |
| Comp. Ex. 4 | 17.8 | 55 | 4 | 2 | ○ |
| Comp. Ex. 5 | 9.2 | 95 | 4 | 1 | X |
| Comp. Ex. 6 | 8.3 | 60 | 5 | 3 | ○ |
| Comp. Ex. 7 | 5.5 | 84 | 4 | 2 | X |

(Experiment 2)

Toners of Examples 7 to 11 and Comparative Examples 8 to 1 were each used as a single-component developer. Image reproduction was made using an electrophotographic printer (SP101: made by Minolta Camera K.K.). Evaluation was made with respect to the following items.

(Difference between Initial Image Density and Image Density After 1000 Times (1K) of Copy)

Under N/N environment conditions, optical reflection density was measured by a Macbeth reflection densitometer with respect to initial image and post-1K copy image thereby to find a difference of ΔID therebetween. If ΔID is less than 0.2, the difference between initial image density and post-copy image density is small. It means that an amount of electrical charge is stable. If ΔID is larger than 0.2, it is considered that there has occurred some toner fusion with the regulation blade and/or sleeve of the development apparatus, so that some change has been caused to the quantity of electrical charge. The results are shown in Table 3. With respect to Examples 7 to 11, the difference ΔID between ID after 1K copy under L/L environment and ID after 1K print under H/H environment was less than 0.2 without exception. In Comparative Examples 8 to 11, ΔID is greater than that under N/N environment; and under L/L environment there occurred some toner fusion with the sleeve and the like, with the result that no uniform electrical charge could be achieved. Further, toner came not to pass through smoothly between the regulation blade and the sleeve, resulted in poor reproduction of image full of black solid. Under H/H environment, electrical charge quantity decreased and more than adequate quantity of toner was developed, resulting in increase in toner consumption.

TABLE 3

| | Initial Max. ID | After copy durability test Max. ID | δID |
|---|---|---|---|
| Ex. 7 | 1.44 | 1.43 | 0.09 |
| Ex. 8 | 1.41 | 1.41 | 0.15 |
| Ex. 9 | 1.40 | 1.42 | 0.12 |
| Ex. 10 | 1.40 | 1.39 | 0.07 |
| Ex. 11 | 1.42 | 1.40 | 0.10 |
| Comp. Ex. 8 | 1.38 | 1.25 | 0.41 |

TABLE 3-continued

| | Initial Max. ID | After copy durability test Max. ID | δID |
|---|---|---|---|
| Comp. Ex. 9 | 1.42 | 1.31 | 0.26 |
| Comp. Ex. 10 | 1.28 | 1.25 | 0.51 |
| Comp. Ex. 11 | 1.40 | 1.35 | 0.22 |

As may be clearly understood from a comparison of Examples 1 to 11 and Comparative Examples 4 to 7 and 9 to 11 as plotted in FIG. 1, toners within the region defined by lines A–B in FIG. 1 are toners which are satisfactory and practical in such aspects as environmental variation range, charge holding rate initial fogging, post-10K fogging, cleaning properties, and image density difference. Outside that region, toner having some deficiency in the above mentioned aspects is merely obtained.

The region defined by lines A and B in FIG. 1 may be expressed by the following relation.

$$\log [Y] = -0.16\,[X] + k \quad (2.4 \leqq k \leqq 2.7)$$

in which [X] represents volume-mean particle size [μm], and [Y] represents the number of 5 μm or smaller toner particles.

Lines C and D are determined in view of the fact that if [X] is smaller than line C, a non-ignorable limitation (e.g., cost) is posed from the standpoint of production, and that if [X] is larger than line D, some disadvantage arises from the view point of high precision image reproduction.

Specifically, [X] value of line C is 5 μm, and [X] value of line D is 11.7 μm.

Further, as in Comparative Examples 1 to 3 and 8, even when a toner is within the region of lines A–D, some disadvantage arises in respect of charge holding rate, post-10K fogging, and/or post-1K image density difference unless a rounding treatment is effected with respect to the surface configuration of the toner. In such a case, no toner suitable for practical use can be obtained (see Tables 2 and 3).

What is claimed is:

1. A toner for developing a digital-image, comprising toner particles which comprise a binder resin and a coloring agent, said binder resin comprising a first polyester resin and a second polyester resin having a softening temperature different from that of the first polyester resin, said toner particles having corner-free configuration with protrusions free of edges and having the following size distribution:

$$\log Y = -0.16\,X + k \quad (2.4 \leqq k \leqq 2.7)$$

$$5.0 \leqq X \leqq 11.7\ \mu m$$

wherein X represents an average particle size by volume size and Y represents % by number of particles of not more than 5 μm.

2. The toner of claim 1, wherein the particles have the following characteristic:

$$|Q1 - Q| \leqq 12\ \mu C/g$$

wherein Q1 represents a charge quantity of the particles under 10° C. and 15% in humidity and Q2 represents a charge quantity of the particles under 30° C. and 85% in humidity.

3. The toner of claim 1, wherein the particles have the following characteristic:

$$|D1 - D2| \leqq 0.2$$

wherein D1 represents an image density of the particles formed under an environment of 10° C. and 15% humidity and D2 represents an image density of the particles formed under an environment of 30° C. and 85% humidity.

4. The toner of claim 1, wherein the X is within the range of $5.0 \leqq X \leqq 9.0$ μm.

5. The toner of claim 1, wherein the particles further comprise an off-set preventive agent of 1–15 parts by weight to the binder resin of 100 parts by weight.

6. The toner of claim 1, wherein the particles further comprise a charge controlling agent of 0.1–20 parts by weight to the binder resin of 100 parts by weight.

7. The toner of claim 1, wherein the particles further comprise a magnetic agent blended into the resin.

8. The toner of claim 1, wherein the particles further comprise a fluidity agent mixed with the particles by 0.05–2% by weight of the particles.

9. The toner of claim 8, wherein the particles further comprise an electroconductive agent blended with the fluidity agent.

10. The toner of claim 9, wherein the electroconductive agent is selected from the group consisting of a titanium dioxide treated by a tin oxide and a titanium dioxide treated by a tin oxide and an antimony oxide.

11. The toner of claim 1, wherein the particles are prepared by:

kneading at least a binder resin and a coloring agent;

cooling the kneaded mixture;

pulverizing the cooled mixture to give primary materials;

pulverizing the primary materials to give a secondary materials; and classifying and rounding the secondary materials by a rotor classifier to give toner particles, the rotor classifier applying physical impact to the secondary materials in order to round off the corner of the materials.

12. The toner of claim 1, wherein the configuration is formed by applying physical impact to toner particles being configured with some angular irregularity.

13. A developer for developing a digital-image, comprising carrier particles; and toner particles which comprise a binder resin and a coloring agent, said binder resin comprising a first polyester resin and a second polyester resin having a softening temperature different from that of the first polyester resin, said toner particles having corner-free configuration with protrusions free of edges and having the following size distribution:

$$\log Y = -0.16\,X + k \quad (2.4 \leqq k \leqq 2.7)$$

$$5.0 \leqq X \leqq 11.7\ \mu\text{m}$$

wherein X represents an average particle size by volume size and Y represents % by number of particles of not more than 5 μM.

14. The developer of claim 13, wherein the toner particles have the following characteristic:

$$|Q1 - Q| \leqq 12\ \mu\text{C/g}$$

wherein Q1 represents a charge quantity of the particles under 10° C. and 15% in humidity and Q2 represents a charge quantity of the particles under 30° C. and 85% in humidity.

15. The developer of claim 13, wherein the X is within the range of $5.0 \leqq X \leqq 9.0$ μm.

16. The developer of claim 13, wherein the toner particles further comprise a hydrophobic silica and an electrical conductive titanium dioxide.

17. The developer of claim 13, wherein the toner particles further comprise an off-set preventive agent.

18. The developer of claim 17, wherein the off-set preventive agent comprises a polyolefin wax.

19. The developer of claim 13, wherein the carrier comprises a binder resin and magnetic particles dispersed in the binder resin.

20. The developer of claim 13, wherein the carrier comprises a magnetic core and a resin coating the surface of the core.

21. The toner of claim 13, wherein the configuration is formed by applying physical impact of toner particles being configured with some angular irregularity.

22. A non-magnetic mono-component toner for developing a digital-image, comprising toner particles which comprise a binder resin and a coloring agent, said binder resin comprising a first polyester resin and a second polyester resin having a softening temperature different from that of the first polyester resin, said toner particles having corner-free configuration with protrusions free of edges and having the following size distribution:

$$\log Y = 0.16\,X + k \quad (2.4 = k \leqq 2.7)$$

$$5.0 \leqq X \leqq 11.7\ \mu\text{m}$$

wherein X represents an average particle size by volume size and Y represents % by number of particles of not more than 5 μm.

23. The toner of claim 22, wherein the toner having the following characteristic:

$$|Q1 - Q| \leqq 12\ \mu\text{C/g}$$

wherein Q1 represents a charge quantity of the particles under 10° C. and 15% in humidity and Q2 represents a charge quantity of the particles under 30° C. and 85% in humidity.

24. The toner of claim 22, wherein X is within the range of $5.0 \leqq X \leqq 9.0$ μm.

25. The toner of claim 22, wherein the configuration is formed by applying physical impact of toner particles being configured with some angular irregularity.

26. A toner for developing a digital-image, comprising toner particles which comprise a binder resin and a coloring agent, said binder resin comprising a first polyester resin and a second polyester resin having a softening temperature different from that of the first polyester resin, said toner particles having corner-free configuration with protrusions free of edges and having the following size distribution:

$$\log Y = -0.16\,X + k \quad (2.4 \leqq k \leqq 2.7)$$

$$5.0 \leqq X \leqq 11.7\ \mu\text{m}$$

wherein X represents an average particle size by volume size and Y represents % by number of particles of not more than 5 μm, said toner particles further comprising finer toner particles not more than one-third of the average toner particle size adhered to and embedded in the surface of said toner particles.

* * * * *